US007419072B1

(12) United States Patent
Vanella

(10) Patent No.: US 7,419,072 B1
(45) Date of Patent: Sep. 2, 2008

(54) BEVERAGE CONTAINER ACCESSORY

(76) Inventor: Dana G. Vanella, 19528 Ventura Blvd., #218, Tarzana, CA (US) 91356

( * ) Notice: Subject to any disclaimer, the term of this patent is extended or adjusted under 35 U.S.C. 154(b) by 373 days.

(21) Appl. No.: 11/156,188

(22) Filed: Jun. 17, 2005

(51) Int. Cl.
*B65D 5/66* (2006.01)

(52) U.S. Cl. ..... 222/113; 362/145

(58) Field of Classification Search ..... 222/113; 362/154, 101, 802; 220/605, 629, 630, 737; 215/395
See application file for complete search history.

(56) References Cited

U.S. PATENT DOCUMENTS

| | | | | |
|---|---|---|---|---|
| 1,389,132 | A | 8/1921 | Galavan | |
| 2,532,181 | A * | 11/1950 | Moore | 362/101 |
| 2,745,947 | A | 5/1956 | Sansous | |
| 3,878,386 | A | 4/1975 | Douglas | |
| 4,336,574 | A | 6/1982 | Goodman | |
| 4,344,113 | A | 8/1982 | Ditto et al. | |
| 4,858,084 | A | 8/1989 | Sheryll | |
| 5,307,250 | A | 4/1994 | Pearson | |
| 5,822,898 | A * | 10/1998 | Weissleder | 40/442 |
| 6,065,848 | A | 5/2000 | Tucker et al. | |
| 6,092,905 | A | 7/2000 | Koehn | |
| 6,305,817 | B1 | 10/2001 | Johnston et al. | |
| 6,352,352 | B1 | 3/2002 | Schletterer et al. | |
| 6,354,711 | B1 | 3/2002 | McCoy | |
| 6,371,624 | B1 | 4/2002 | Dorney | |
| 6,379,018 | B1 | 4/2002 | Rycroft et al. | |
| 6,416,198 | B1 | 7/2002 | Vanderschuit | |
| 6,443,589 | B1 | 9/2002 | Lee | |
| 6,511,196 | B1 | 1/2003 | Hoy | |
| 6,511,197 | B1 | 1/2003 | Kalemjian | |
| 6,619,811 | B2 | 9/2003 | Wang et al. | |
| 6,746,132 | B2 | 6/2004 | Liu | |
| 6,762,734 | B2 | 7/2004 | Blotky et al. | |
| 6,786,614 | B2 | 9/2004 | Ciarrocchi, Jr. | |
| 6,793,363 | B2 | 9/2004 | Jensen | |
| 6,863,415 | B2 | 3/2005 | Lu | |
| 2003/0076672 | A1 * | 4/2003 | Head | 362/101 |

* cited by examiner

*Primary Examiner*—Lien T Ngo
(74) *Attorney, Agent, or Firm*—Loyal McKinley Hanson

(57) ABSTRACT

An illuminate-able beverage-ware device includes a bottle-supporting component with a base and a bottle-gripping sidewall that cooperatively define an upwardly opening space for receiving a bottle or other beverage container. An actuator arrangement actuates a battery-powered light source that transmits lights upwardly toward the false bottom, outwardly through the sidewall, and downwardly toward the base, while inwardly extending protrusions on a circularly shaped sidewall of one embodiment hold the device on the bottle when the bottle is lifted (e.g., to a drinking position). The false bottom, sidewall, and base are all at least partially transparent to light so that light is transmitted upwardly through the false bottom toward the bottle (e.g., to illuminate a beverage within the bottle), outwardly through the sidewall, and downwardly through the base (e.g., to illuminate information on the underside of the base for a highly visible additional display of information to a bystander when the bottle is raised to a drinking position).

6 Claims, 4 Drawing Sheets

Fig. 4
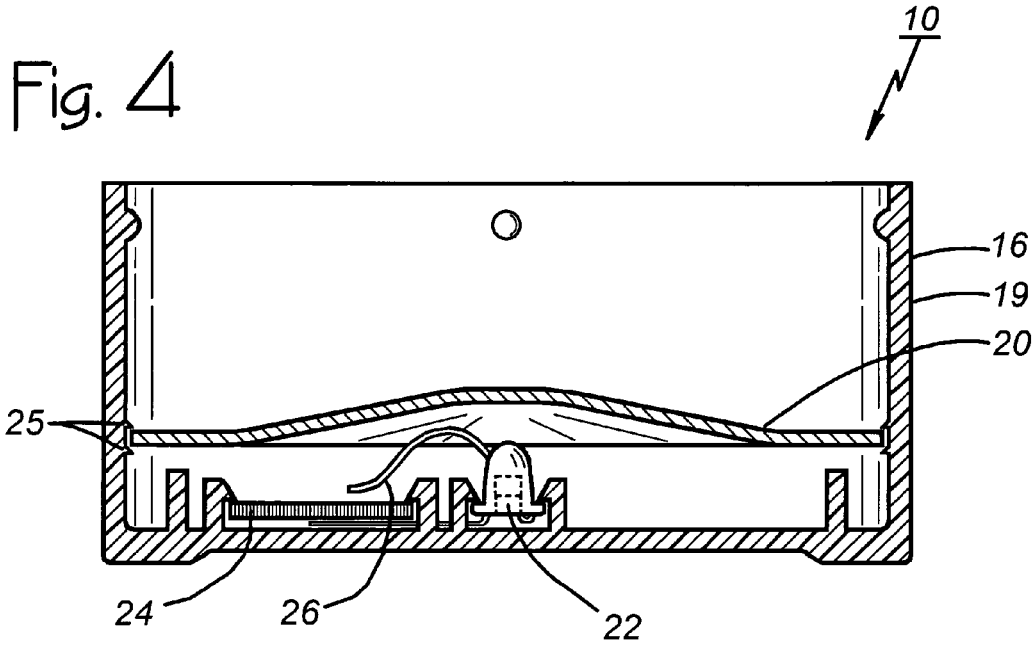
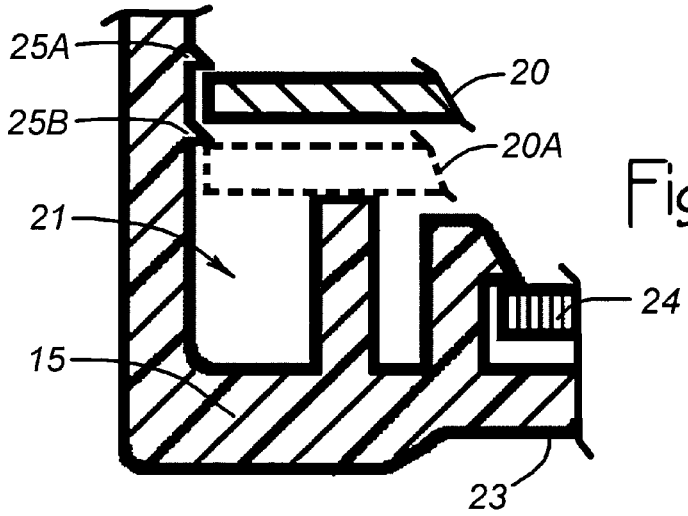
Fig. 5
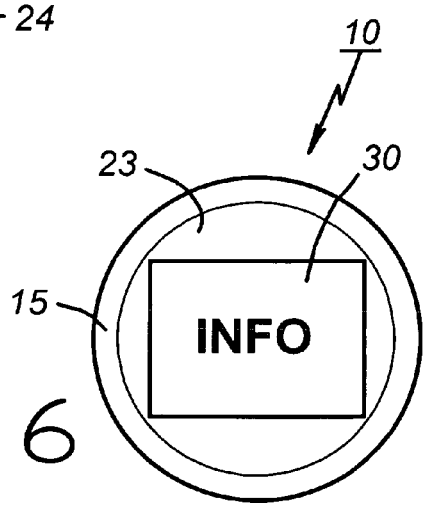
Fig. 6

BEVERAGE CONTAINER ACCESSORY

BACKGROUND OF THE INVENTION

1. Technical Field

This invention relates generally to beverage-ware in the form of beverage container coasters, holders, receptacles, and the like. More particularly, it relates to an illuminate-able beverage container accessory on which to set a water bottle, beer bottle, wine cooler, or other beverage container.

2. Description of Related Art

Manufacturers have in the past provided a vast variety of coasters, holders, bases, and other such beverage-ware devices for use with beverage containers. Such beverage-ware devices are designed for any of various functional, decorative, and/or novelty-item uses, including advertising and promotional purposes. Some devices use light with some success for ambience-setting and to help attract attention for advertising purposes, and so that subset of such devices is of particular interest.

One problem with existing illuminated coasters and the like are that they can be bulky, complicated, and expensive. In addition, light may be projected upwardly and/or to the side of an upright beverage container where it is not clearly visible when the beverage container is moved to any of various tilted drinking positions. Thus, a need exists for an illuminate-able beverage container accessory with just the right combination of elements for less bulk, complexity, and expense coupled with improved functionality.

SUMMARY OF THE INVENTION

This invention addresses the need outlined above by providing a lighter, less bulky, more inexpensively manufactured, clear or transparent beverage-ware device that grips and illuminates a bottle. The device has a transparent base and a battery-powered light source that not only directs light upwardly toward the bottle and bottle contents and outwardly toward the vertical sidewall, but also downwardly through the base. Thus, the device illuminates a horizontal support surface on which it is set (e.g., a table top, bar top, or napkin that it is set upon for the decorative effect produced), and it also directs light outwardly toward bystanders when the bottle is lifted and tilted to a drinking position (for the effect produced and/or to attract attention to information displayed on the underside of the base).

Various embodiments have those features and much more. The device can be configured to project images at a desired angle. Images can be projected by means of one or more decorative-pattern-producing gobos, refractors, and/or lenses. The entire unit, including the underside of the base, may be configured with or without logos or other information. A color-changing wheel and/or multiple lights may be included.

To paraphrase some of the more precise language appearing in the claims and further introduce the nomenclature used, a beverage-ware device constructed according to the invention includes a bottle-supporting component for supporting a bottle on a horizontal support surface. The bottle-supporting component has a base portion and a bottle-gripping portion extending upwardly from the base portion such that the base portion and the bottle-gripping portion cooperatively define an upwardly opening space for receiving a lower portion of the bottle. The bottle-gripping portion of the bottle-supporting component is adapted to bear against the lower portion of the bottle in tight-fitting engagement of the lower portion in order to hold the bottle-supporting component on the bottle when the person lifts the bottle. The bottle-gripping portion may take the form of a circularly shaped sidewall having inwardly extending protrusions that provide the tight-fitting engagement, although another bottle-gripping portion (not shown) includes a glue, putty, or foam-type ring.

A false-bottom component may be provided within the upwardly opening space such that the base portion and the false-bottom component cooperatively define a downwardly disposed space. A battery-powered light source component within the downwardly disposed space at least partially illuminates the bottle, the sidewalls, and the base portion of the bottle-supporting component. Light-actuating means are included for actuating the light source component by action of a person placing the lower portion of the bottle into the upwardly opening space of the bottle-supporting component. Preferably, the false-bottom component is moveable so that it may function as an actuator.

According to a major aspect of the invention, the base portion of the bottle-supporting component, the sidewall, and the false-bottom component are at least partially transparent to light so that light is transmitted through the false-bottom component toward the bottle (and bottle contents) and through the sidewall, in addition to being transmitted through the base portion of the bottle-supporting component away from the bottle. Thus, the device illuminates a table top, bar top, napkin, or other horizontal support surface on which it is set, and it also directs light outwardly toward bystanders when the bottle is lifted and tilted to a drinking position (for the noticeable effect produced and/or to attract attention to information displayed on the underside of the base). The following illustrative drawings and detailed description make the foregoing and other objects, features, and advantages of the invention more apparent.

BRIEF DESCRIPTION OF THE DRAWINGS

FIG. 4 is an elevation view similar to FIG. 3 that shows the first embodiment of the device with the false-bottom component in an OFF position;

FIG. 5 is an enlarged portion of the first embodiment of the device shown in FIG. 2 that illustrates details of the false-bottom retainer protrusions;

FIG. 6 is bottom plan view of the accessory that illustrates information displayed on an underside of the base portion when a user raises the bottle shown in FIG. 1 to a drinking position.

DESCRIPTION OF THE PREFERRED EMBODIMENTS

Figure 1:
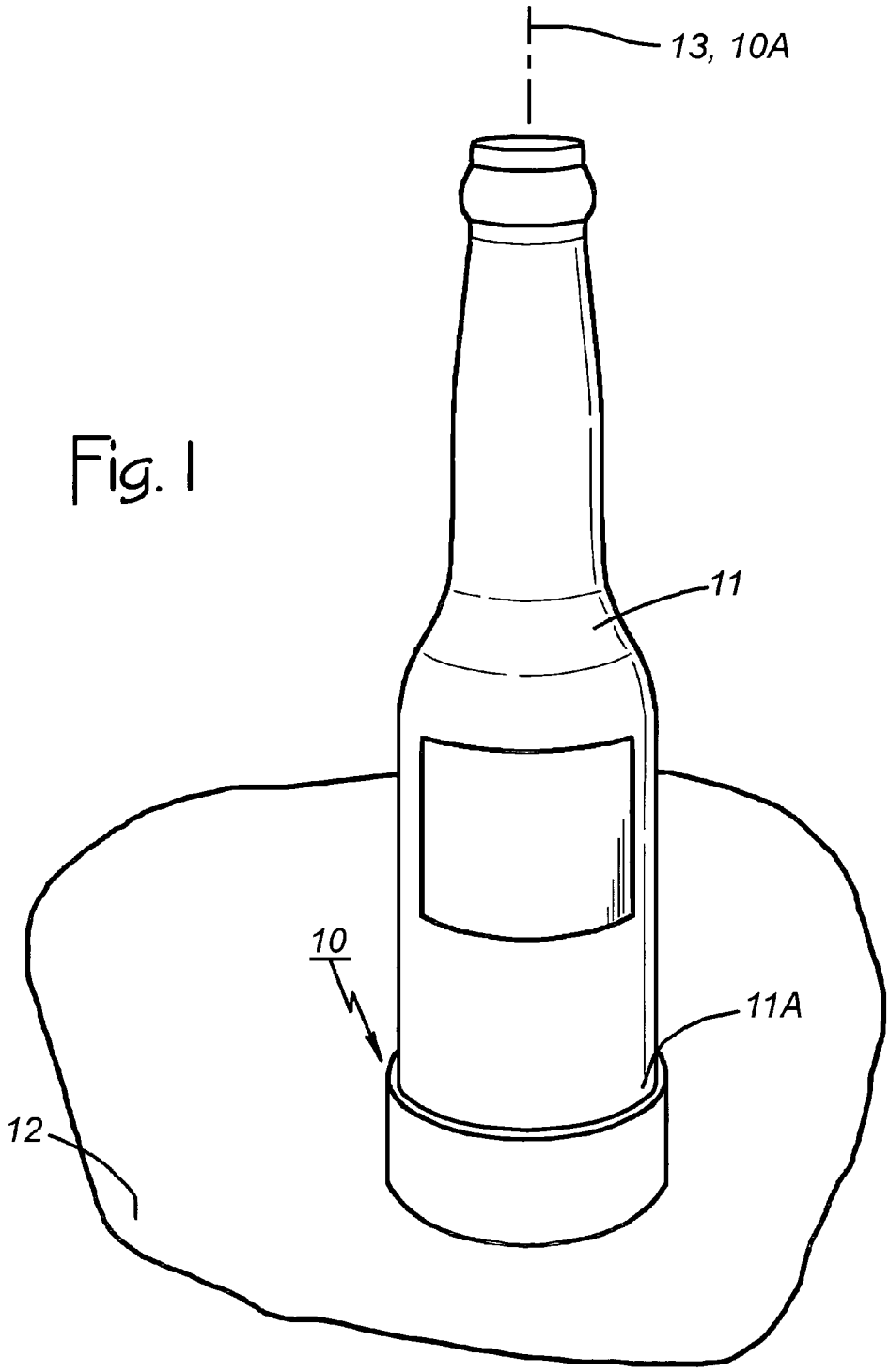
FIG. 1 of the drawings is a perspective view of a first embodiment of a decorative beverage container accessory device (i.e., a beverage-ware device) constructed according to the invention in its typical environment, installed on the lower portion of a bottle.

FIGS. 1-6 of the drawings show various aspects of a beverage-ware device 10 constructed according to the invention. The device 10 is shown in FIG. 1 supporting a bottle 11 atop a horizontal support surface 12, with a central bottle axis 13

(i.e., the axis of elongation) disposed vertically and aligned with a central axis 10A of the device 10.

Figure 2:
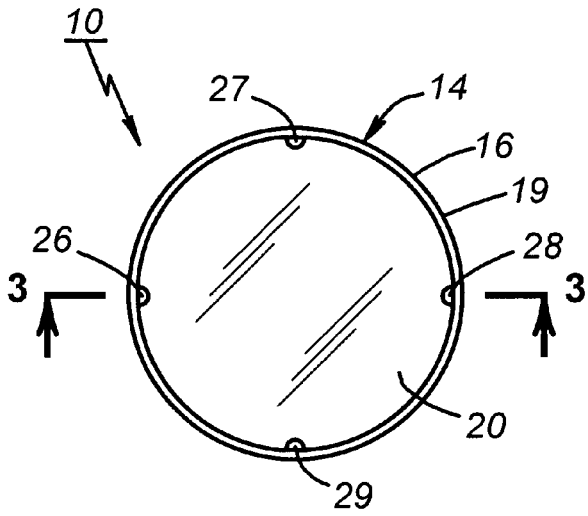
FIG. 2 is a top plan view of just the first embodiment of the beverage container accessory device.
Figure 3:
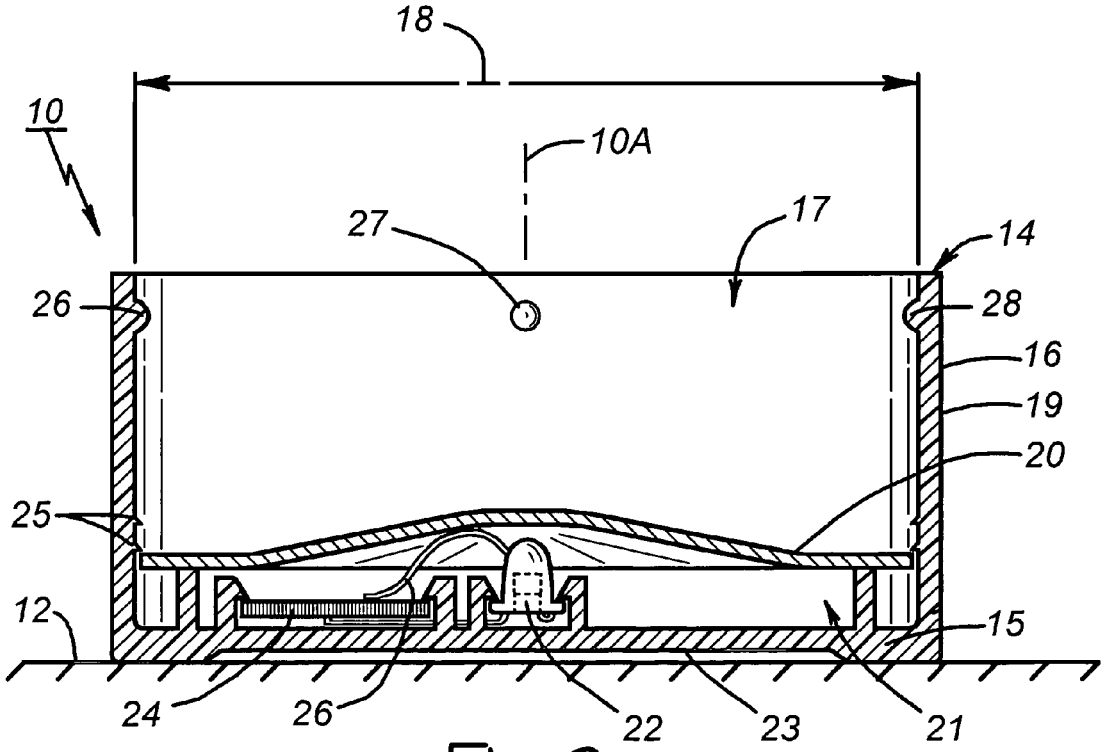
FIG. 3 is an elevation view of the first embodiment of the device, with portions illustrated in cross-section as viewed in a vertical bisecting plane containing a line 3-3 in FIG. 2.

Generally, the device 10 includes bottle-supporting means for supporting the bottle 11 on the horizontal support surface 12, including a bottle-supporting component 14 (FIGS. 2 and 3) having a downwardly facing base portion 15 and a bottle-gripping portion 16 extending upwardly from the base portion 15 (FIGS. 2 and 3). The bottle-supporting component is preferably a molded one-piece plastic structure for less weight, complexity and cost of fabrication, although other compositions and fabrication techniques are within the broader inventive concepts disclosed, and more than one type of plastic can be used within the same unit. The base portion 15 and the bottle-gripping portion 16 cooperatively define an upwardly opening space 17 (identified in FIG. 3) for receiving a lower portion 11A of the bottle 11 shown in FIG. 1. The space 17 has a size and shape similar to the size and shape of the lower portion 11A of the bottle 11 (i.e., the bottom portion of the bottle), being circularly shaped for the illustrated device 10 (i.e., somewhat cylindrically shaped). In other words, the space 17 mates with the bottle 11.

As a further idea of size, shape, and construction, the illustrated device 10 measures roughly 2.5 inches in diameter (as depicted in FIG. 3 by a dimension 18) so that the space 17 is large enough to receive the lower portion of a particular bottle and other similarly sized bottles. In addition, the illustrated bottle-holding component 14 is a molded plastic component having a circularly shaped sidewall 19 (FIGS. 2 and 3) measuring about 1/16 inch to 3/32 inch thick, for less weight, complexity, and expense. Of course, those exact dimensions and details of construction may vary significantly within the inventive concepts disclosed and the scope of the claims in order to accommodate a beverage container having a different size and/or shape than the illustrated bottle 11, such as a beverage container with a square or other non-circular cross section.

A false-bottom component 20 is disposed within the upwardly opening space 17 of the illustrated embodiment, although a false-bottom component need not be included within the broader inventive concepts disclosed. The base portion 15 and the false-bottom component 20 cooperatively define a downwardly disposed space 21 (FIG. 3). Bottle-illuminating means in the form of a battery-operated light source 22 within the downwardly disposed space 21 at least partially illuminates the bottle 11 through the false-bottom component 20. The false-bottom component may define a notch or slit (not shown) for use in removing it for access to the battery.

The false-bottom component 20 is at least partially transparent to light for that purpose (e.g., clear or colored plastic). The light source 22 also illuminates the horizontal support surface or other object disposed downwardly from the device 10 though the base portion 15 (preferably illuminating the sidewall too). The base portion 15 is at least partially transparent to light for that purpose. Thus, the base portion 15 and the false-bottom component 20 (and, preferably, the sidewall) are at least partially transparent to light (e.g., transparent plastic) so that light is transmitted upwardly through the false-bottom component 20 toward the bottle 11 (and any bottle contents), in an opposite downwardly direction through the base portion 15 toward a table top, bar top, napkin, or other horizontal support surface on which the device 10 is set, and outwardly through the sidewall.

The light source component 22 may take any of various forms, including one or more LEDs or other light-emitting components that connect to a battery 24 for power to produce one or more colors of visible light. The light source component 22 may include one or more light-emitting components mounted in any of various locations in or on the unit so that light is directed or focused in any desired direction. The lights may flash. Projected images may be still or moving, including audio/video or visual. An audio playing device may be mounted within the unit (e.g., music or voice message). A series-connected current-limiting resistor, a microchip, and/or other electrical circuit components (not shown) may be included according to the particular light-source circuit configuration desired, including solar and/or audio devices. In addition, a separate access door may be included for use in replacing batteries.

In order to turn on the light source component 25, the illustrated device 10 includes light-actuating means for actuating the light source component by action of a person placing the lower portion 11A of the bottle 11 into the upwardly opening space 17. This is accomplished in the illustrated device 10 by having the false bottom 20 moveable. It is a dome-shaped, disc-like component that an assembler slides downwardly during assembly to an OFF position of the false bottom 20 that is shown in FIG. 4. The false bottom 20 is initially held in the OFF position by upwardly disposed inwardly extending protrusions. Multiple circumferentially spaced apart pairs 25 of such protrusions restrain the false bottom 20 in position, and additional protrusion pairs may be included for proper false-bottom placement. Each pair is similar and so only one pair 25 is identified in FIGS. 3 and 4.

Each protrusion pair 25 includes an upwardly disposed first protrusion 25A and a downwardly disposed second protrusion 25B (FIG. 5). The assembler positions the false bottom 20 component intermediate the first and second protrusions 25A and 25B (i.e., the OFF position). The action of a person placing a bottle onto the false bottom 20 causes the false bottom 20 to move downwardly under influence of the bottle, from the OFF position of the false bottom 20 (shown in FIG. 4 and FIG. 5 by solid lines) to an ON position of the false bottom 20 (shown in FIG. 3 by solid lines and in FIG. 5 by broken lines). In the OFF position, a wire 26 (which represents any of various electrically conductive elements, including a spring or other means) does not contact a terminal on the battery 24 (FIG. 4). In the ON position, the false bottom 20 forces the wire 26 into contact with a terminal on the battery 24 in order to thereby actuate the light-emitting component (FIG. 3). Of course, other ON/OFF switching means may be used instead.

With further regard to the bottle-gripping portion 16 of the bottle-supporting component 14, it is adapted to bear against the lower portion 11A of the bottle 11 in tight-fitting engagement of the lower portion 11A in order to hold the bottle-supporting component 14 on the bottle 11 when the person lifts the bottle 11 (e.g., to a drinking position of the bottle 11). This is accomplished for the illustrated device 10 by providing four inwardly extending gripping protrusions 26, 27, 28, and 29 (FIGS. 2 and 3). The gripping protrusions 26-29 bear radially inwardly against the lower portion 11A of the bottle 11 under influence of slight resilient deformation of the bottle-gripping portion 16 in order to thereby hold the device 10 on the bottle 11 when the bottle 11 is lifted from the horizontal support surface 12. Bottle-gripping protrusions may be placed in different positions in order to accommodate different beverage containers and the entire unit may be configured to accept a selective brand. In addition, glue, putty, and the like, including a foam ring, may be incorporated with or in place of the gripping protrusions to keep a tighter hold of the bottle if necessary.

FIG. 6 shows information displayed on the underside 23 of the base portion 15. The letters "INFO" in box 30 in FIG. 6 represent any graphical and/or text information that may be desired, including advertising and/or promotional information. Lifting the bottle 11 to a drinking position, clearly displays the information, and the downwardly transmitted light attracts attention to it. Concerning the terms "upwardly" and "downwardly" herein, those terms refer to relative positions when the central bottle axis 13 is disposed vertical with the device 10 on a horizontal support surface as shown in FIG. 1. Thus, "downwardly transmitted light" (i.e., light transmitted through the base portion 15) may be directly horizontally when the bottle 11 is raised to a drinking position in which the axis 13 is horizontally disposed. Moreover, "outwardly directly" light transmitted through the sidewall refers to light transmitted perpendicular to the central bottle axis 13, and so it may be directed upwardly, outwardly, and downwardly when the bottle is in the drinking position.

Figure 7:
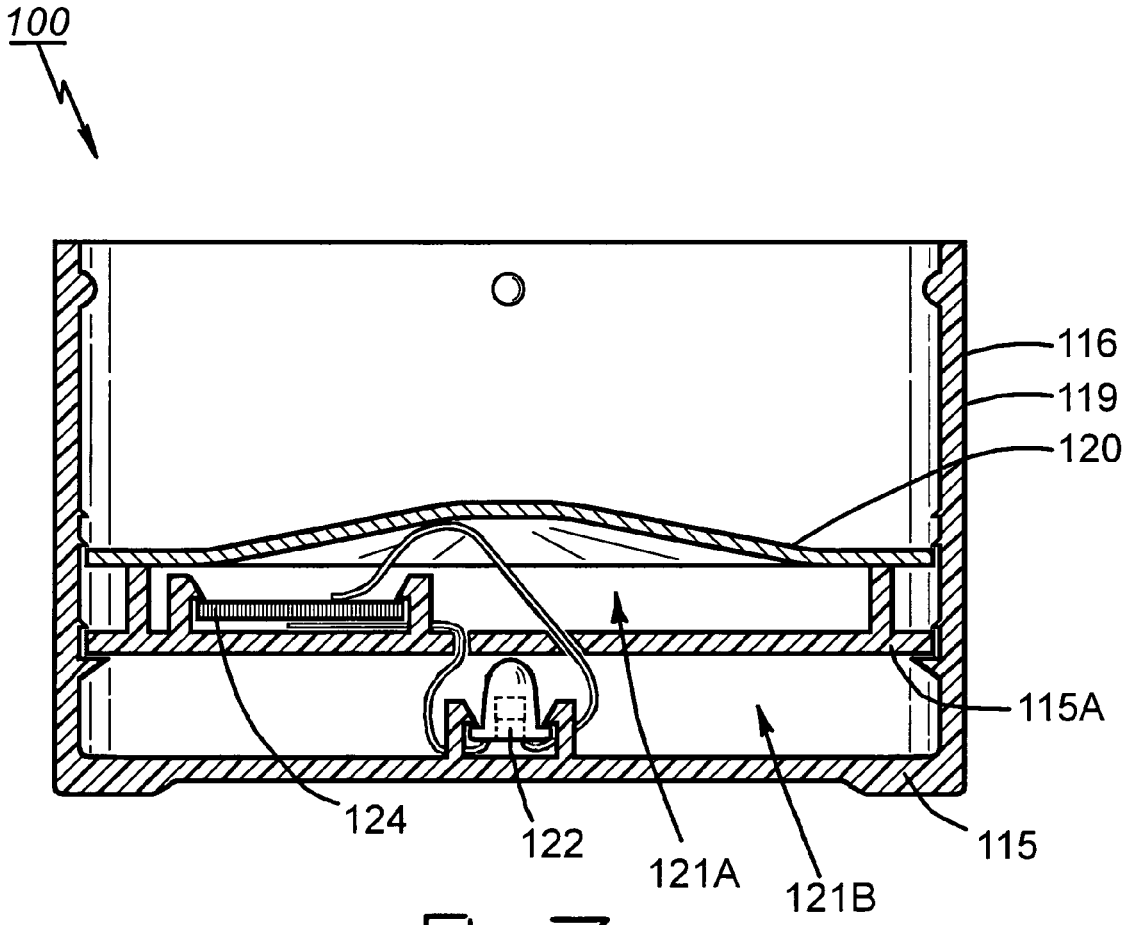
FIG. 7 is an elevation view similar to FIG. 3 of a second embodiment of the invention.

Concerning FIG. 7, it shows a second embodiment of the invention in the form of a device 100. The device 100 is similar in many respects to the device 10 and so only major differences are described in further detail. For convenience, reference numerals designating parts of the device 100 are increased by one hundred over those designating similar or related parts of the device 10.

Similar to the device 10, the device 100 includes a bottle-gripping portion 116 with a circularly shaped sidewall 120 extending from a base portion 115, and a battery operated light source 122 is powered by a battery 124. The major difference is that a false bottom component 120, the base component 115 are supplemented by a secondary base component 115A to define an upwardly disposed first or battery compartment 121A and a downwardly disposed second or light component compartment 121B. The battery 124 is held in the first compartment 121A where it does not block downward and sideways transmission of light in the second compartment 121B.

Thus, the invention provides a lighter, less bulky, more inexpensively manufactured, beverage-ware device having a transparent base and a battery-powered light source that not only directs light upwardly toward the bottle and bottle contents, and outwardly through the sidewall, but also downwardly through the base. The device illuminates a horizontal support surface on which it is set (e.g., a table top, bar top, or napkin that it is set upon for the decorative effect produced), and it directs light outwardly toward bystanders even when the bottle is lifted and tilted to a drinking position (for the effect produced and/or to attract attention to information displayed on the underside of the base). The device can be configured to project images at a desired angle. Images can be projected by means of one or more decorative-pattern-producing gobos, refractors, and/or lenses. The entire unit, including the sidewall and the underside of the base, may be configured with or without logos or other information. A color-changing wheel and/or multiple lights may be included, including multi-colored lights. Moreover, the unit can use glow-in-the-dark powder in the plastic and/or the displayed information (or a chemiluminescent substance), and the battery-powered components may be omitted for stand-alone use of the bottle-holding component (e.g., outdoors in the sun). Although exemplary embodiments have been shown and described, one of ordinary skill in the art may make many changes, modifications, and substitutions without necessarily departing from the spirit and scope of the invention.

What is claimed is:

1. A device, comprising:

bottle-supporting means for supporting a bottle on a horizontal support surface, said bottle-supporting means including a bottle-supporting component having a downwardly facing base portion and a bottle-gripping portion extending upwardly from the base portion such that the base portion and the bottle-gripping portion cooperatively define an upwardly opening space for receiving a lower portion of the bottle;

a false-bottom component within the upwardly opening space such that the base portion, the false-bottom component, and the bottle-gripping portion cooperatively define a downwardly disposed space;

bottle-illuminating means for transmitting light upwardly toward the false-bottom component and downwardly toward the base, said means including a battery-powered light source component within the downwardly disposed space; and light-actuating means for actuating the light source component by action of a person placing the lower portion of the bottle into the upwardly opening space of the bottle-supporting component;

wherein the bottle-gripping portion of the bottle-supporting component is adapted to bear against the lower portion of the bottle in tight-fitting engagement of the lower portion in order to hold the bottle-supporting component on the bottle when the person lifts the bottle;

wherein the base portion of the bottle-supporting component and the false-bottom component are at least partially transparent to light so that light is transmitted upwardly through the false-bottom component toward the bottle and downwardly through the base portion toward the horizontal support surface;

wherein the false-bottom component is moveable within the upwardly opening space so that the false-bottom component is adapted to move downwardly in response to the person placing the lower portion of the bottle into the upwardly opening space of the bottle-supporting component in order to thereby actuate the battery-powered light source component; and wherein the bottle-gripping portion of the bottle-supporting component includes a sidewall and said sidewall includes retaining means for retaining the false-bottom component in a first position of the false-bottom component in which the false-bottom component does not actuate the battery-powered light source while enabling movement of the false-bottom component under influence of the bottle to a second position of the false-bottom component in which the false-bottom component does actuate the battery-powered light source.

2. A device, comprising:

bottle-supporting means for supporting a bottle on a horizontal support surface, said bottle-supporting means including a bottle-supporting component having a downwardly facing base portion and a bottle-gripping portion extending upwardly from the base portion such that the base portion and the bottle-gripping portion cooperatively define an upwardly opening space for receiving a lower portion of the bottle;

a false-bottom component within the upwardly opening space such that the base portion, the false-bottom component, and the bottle-gripping portion cooperatively define a downwardly disposed space;

bottle-illuminating means for transmitting light upwardly toward the false-bottom component and downwardly toward the base, said means including a battery-powered light source component within the downwardly disposed space; and light-actuating means for actuating the light source component by action of a person placing the lower portion of the bottle into the upwardly opening space of the bottle-supporting component;

wherein the bottle-gripping portion of the bottle-supporting component is adapted to bear against the lower portion of the bottle in tight-fitting engagement of the lower portion in order to hold the bottle-supporting component on the bottle when the person lifts the bottle;

wherein the base portion of the bottle-supporting component and the false-bottom component are at least partially transparent to light so that light is transmitted upwardly through the false-bottom component toward the bottle and downwardly through the base portion toward the horizontal support surface;

wherein the bottle-gripping portion of the bottle-supporting component includes a circularly shaped sidewall extending upwardly from the base portion and the sidewall includes a plurality of at least three inwardly extending protrusions that are adapted to bear inwardly against the lower portion of the bottle in tight-fitting engagement of the lower portion; and wherein the sidewall includes means for retaining the false-bottom component in a first position of the false-bottom component in which the false-bottom component does not actuate the battery-powered light source while enabling movement of the false-bottom component under influence of the bottle to a second position of the false-bottom component in which the false-bottom component does actuate the battery-powered light source, said means including at least three pairs of inwardly extending protrusions on the sidewall such that the pairs are spaced apart circumferentially at uniform intervals and such that each pair includes two vertically spaced apart protrusions.

3. A device as recited in claim 2, wherein the sidewall is at least partially transparent to light so that light is transmitted outwardly from the downwardly disposed space through the sidewall.

4. A device as recited in claim 2, wherein the bottle-supporting component is a molded one-piece plastic structure.

5. A device as recited in claim 2, further comprising information displayed on an underside of the base portion.

6. A device, comprising:

bottle-supporting means for supporting a bottle on a horizontal support surface, said means including a bottle-supporting component having a downwardly facing base portion and a bottle-gripping portion extending upwardly from the base portion such that the base portion and the bottle-gripping portion cooperatively define an upwardly opening space for receiving a lower portion of the bottle;

a false-bottom component within the upwardly opening space such that the base portion, the false-bottom component, and the bottle-gripping portion cooperatively define a downwardly disposed space;

bottle-illuminating means for transmitting light upwardly toward the false-bottom component and downwardly toward the base portion, said bottle-illuminating means including a battery-powered light source component on the base portion of the bottle supporting component;

light-actuating means for actuating the light source component by action of a person placing the lower portion of the bottle into the upwardly opening space of the bottle-supporting component, said light-actuating means including the false-bottom component, and the false-bottom component being disposed moveably within the upwardly opening space in a position above the battery-powered light source component such that the false-bottom component is adapted to actuate the battery-powered light source component under influence of the bottle; and tight-fitting means for gripping the lower portion of the bottle in order to hold the device on the bottle when the person lifts the bottle, said tight-fitting means including a plurality of at least three inwardly extending protrusions on the bottle-gripping portion of the bottle-supporting component, said inwardly extending protrusions being adapted to bear inwardly against the lower portion of the bottle in tight-fitting engagement of the lower portion;

wherein the base portion of the bottle-supporting component and the moveable false-bottom component are at least partially transparent to light so that light is transmitted through the false-bottom component toward the bottle and through the base portion of the bottle-supporting component away from the bottle;

wherein the bottle-gripping portion of the bottle-supporting component includes a sidewall and said sidewall includes retaining means for retaining the false-bottom component in a first position of the false-bottom component in which the false-bottom component does not actuate the battery-powered light source while enabling movement of the false-bottom component under influence of the bottle to a second position of the false-bottom component in which the false-bottom component does actuate the battery-powered light source.

* * * * *